United States Patent [19]

Warheit

[11] Patent Number: 4,651,598

[45] Date of Patent: Mar. 24, 1987

[54] SELF-ADJUSTING UTILITY PLIER

[76] Inventor: William A. Warheit, 121 Iroquois Dr., Butler, Pa. 16001

[21] Appl. No.: 654,405

[22] Filed: Sep. 26, 1984

[51] Int. Cl.[4] ..... B25B 7/04

[52] U.S. Cl. ..... 81/407; 81/405; 81/408; 81/314; 81/394

[58] Field of Search ..... 81/393, 394, 405, 407, 81/409.5, 411, 413, 406, 408, 409, 412

[56] References Cited

U.S. PATENT DOCUMENTS

| | | | |
|---|---|---|---|
| 2,531,285 | 11/1950 | Manspeaker | 81/408 X |
| 4,269,089 | 5/1981 | Hastings | 81/411 X |
| 4,438,669 | 3/1984 | Hastings | 81/409.5 |

FOREIGN PATENT DOCUMENTS

| | | | |
|---|---|---|---|
| 958459 | 2/1957 | Fed. Rep. of Germany | 81/407 |
| 969920 | 7/1958 | Fed. Rep. of Germany | 81/411 |
| 1060330 | 6/1959 | Fed. Rep. of Germany | 81/407 |
| 2031661 | 1/1971 | Fed. Rep. of Germany . | |
| 2456592 | 1/1981 | France | 81/407 |

*Primary Examiner*—Frederick R. Schmidt
*Assistant Examiner*—Maurina Rachuba
*Attorney, Agent, or Firm*—George C. Atwell

[57] ABSTRACT

Utility pliers for single-handed manual manipulation which will automatically adjust to positions of positive gripping and holding of any size workpiece within the size range defined by the maximum opening between the jaws of the pliers.

14 Claims, 6 Drawing Figures

SELF-ADJUSTING UTILITY PLIER

BACKGROUND OF THE INVENTION

The invention pertains to utility pliers having cooperating tooth and pawl construction and more particularly to pliers of the self-adjusting type. The pliers according to the invention, by means of a single-handed manipulation by the user, will cause the jaws thereof, when engaging a workpiece, to instantly and automatically assume a position that will positively grip and hold the workpiece.

A number of U.S. patents show and describe pliers which feature such components as rack teeth, pawls, toothed blocks and self-adjusting jaws to perform their intended functioning. For reference to the teachings of these disclosures attention is hereby drawn to U.S. Pat. Nos. 1,651,216; 2,531,285; 2,988,941; 4,269,089; 4,438,669; and to West German Patent Nos. 958,459 (Patentschrift) and 1,060,330 (Auslegeschrift).

SUMMARY OF THE INVENTION

The self-adjusting utility pliers according to the invention includes first and second handle members having first and second jaws respectively forming one end of each. One jaw end includes an elongated channel with opposed and interconnected side walls. One side of the channel defines a raceway and the other has a series of teeth. A pawl member is pivotably connected to the other jaw end and is confined within the elongated channel by a fastener that assembles the handle members together.

A spring biased control arm interconnects the two handles intermediate their ends and continually urges one side of the pawl into frictional contact with the raceway which is effective in placing the handles and their jaws into positions of spaced and opposed relation. Upon movement of the handles and jaws toward one another, the control arm, on engagement of a workpiece by the jaws, causes the pawl to leave the raceway and be cammed to a position where it is in locking engagement between two adjacent teeth.

It is a general object of the invention to provide utility pliers of the self-adjusting type.

A further object is to provide self-adjusting pliers that can be manipulated by a single-handed operation.

A still further object is to provide self-adjusting pliers which are inexpensive to manufacture and with long life expectancy.

These and other objects of the invention will become more fully apparent by reference to the appended claims, as the following detailed description proceeds in reference to the figures of drawing wherein:

DESCRIPTION OF THE PREFERRED EMBODIMENT

Figure 1:
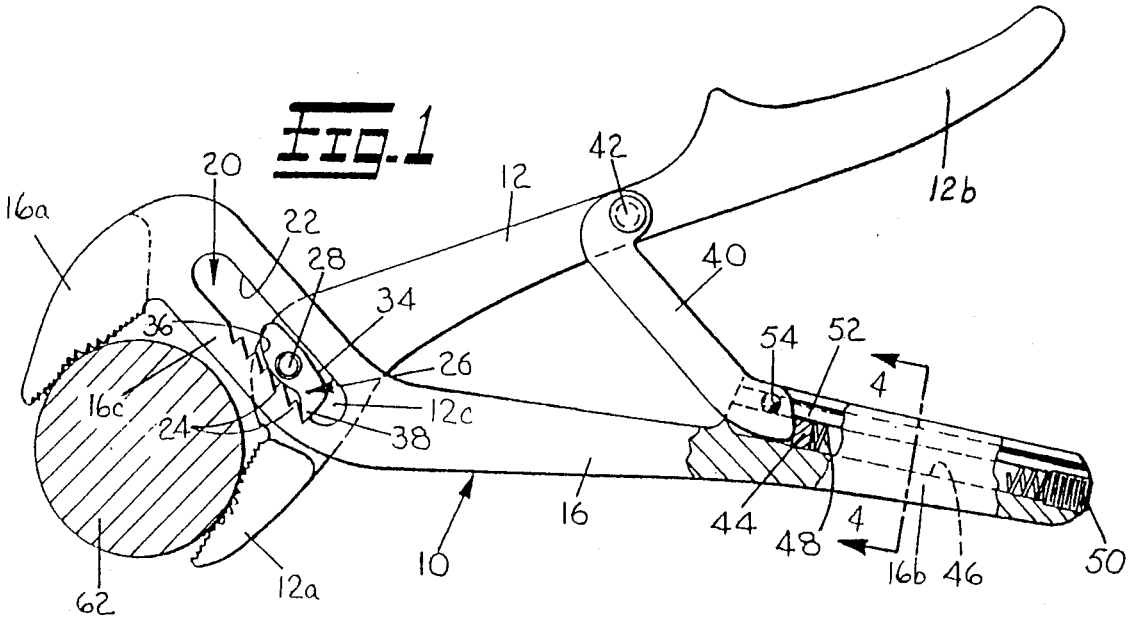
FIG. 1 is a view in side elevation and partially in section of the self-adjusting pliers according to the invention.

Referring now to the Figures of the drawing, the self-adjusting utility pliers according to the invention are identified generally by numeral 10. Components thereof include a first elongated handle member 12 having a jaw or jaw end **12*a*, a handle end 12*b*, and an intermediate neck portion 12*c*. A second elongated handle member is depicted by numeral 16 and has a jaw or jaw end 16*a*, a handle end 16*b*, and an intermediate neck portion 16*c***.

The neck portion **16*c* has an elongated channel or slot 20 formed therein. This elongated channel 20 has interconnected side walls, one of which defines a raceway 22, and one of which has a series of projections or teeth 24** formed along a greater portion of the length thereof.

Figure 5:
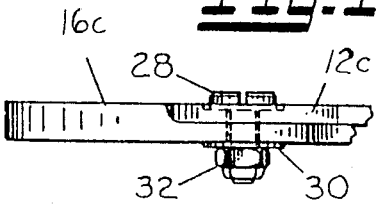
FIG. 5 is a top view of a portion of the pliers shown in FIG. 1, particularly illustrating the fastener means for assembling the jaws together.

The neck portion **12*c* has a pawl member, generally indicated by numeral 26, pivotably mounted on the neck portion 12*c* by means of a bolt 28 which projects a post portion through the channel 20 for securing the pawl number 26 in its operable position. This bolt 28, as shown in FIG. 5 serves, in combination with a washer 30 and nut 32, as a means of assembling the two neck portions 12*c* and 16*c*** together.

Pawl member 26 has a planar surface 34, a camming surface 36 and a tip 38 all of which will be more fully explained hereinafter.

The first member 12 has, intermediate its ends, the upper end of a control arm 40 pivotably attached thereto by means of a pivot pin 42.

Figure 6:
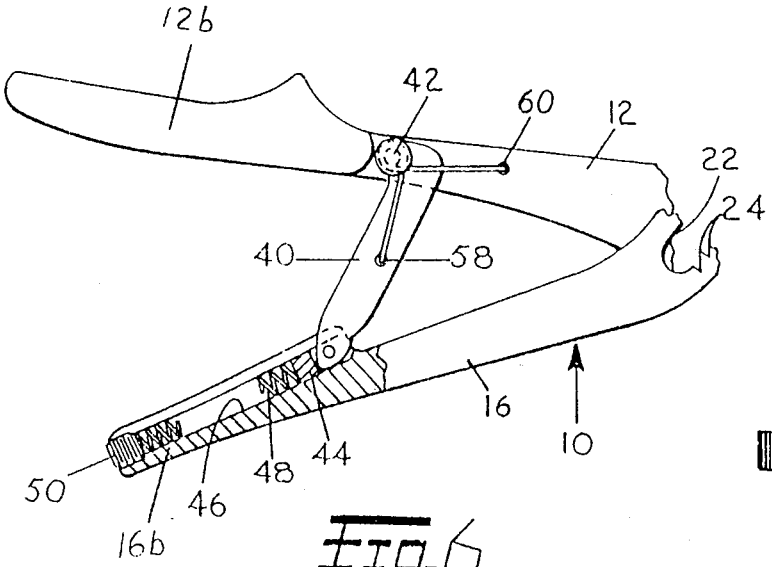
FIG. 6 is a partial reversed side elevational view similar to the structure shown in FIG. 1 and illustrating an alternative means for biasing a control arm component of the disclosed pliers to thereby obtain the desired automatic adjustment and workpiece gripping function.

As shown in FIGS. 1 and 6, the lower end of the control arm 40 engages a guide block 44 assembled within a cylindrical channel 46 formed in the end **16*b* of the second member 16. A coil spring 48 also is assembled in this cylindrical channel with one end thereof engaging the guide block 44. The opposite end of coil spring 48 engages an adjusting screw 50 assembled in the end 16*b* of the second handle member 16 and provides a means for selectively increasing or decreasing the amount of spring tension on the control arm 40**.

It can be easily understood that movement of the members 12 and 16 toward one another will cause the control arm to move downwardly into the cylindrical channel 46 and compress the coil spring 48. Release of the members 12 and 16 causes coil spring 48 to seek its free length so that respective jaws **12*a* and 16*a*** are moved to positions of spaced and opposed relation.

Figure 4:
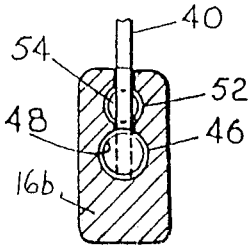
FIG. 4 is a sectional view taken on lines 4—4 of FIG. 1.

As shown in FIGS. 1 and 4, a second and smaller cylindrical channel 52 is also formed in the handle end **16*b*. This cylindrical channel 52 extends parallel with and is disposed immediately above the cylindrical channel 46. This smaller cylindrical channel serves as a guide track for a guide ball 54** assembled in the control arm adjacent its lower end.

A modification of the self-adjusting pliers is shown in FIG. 6 and includes in addition to coil spring 48 a torsion spring 56 which assembles on the pivot pin 42 and is operatively connected to the control arm 40 as at 58 and to the first member 12 as at 60.

To summarize the operation of the self-adjusting utility pliers, the combination of the control arm 40 and the coil spring 48 continually urges the first and second members 12 and 16 and their respective jaw ends 12*a* and 16*a* to positions of spaced and opposed relation. When in these positions a rearward pressure is applied through bolt 28 and is effective in causing the planar surface 34 of the pawl member 26 to maintain frictional contact with the raceway 22. This mode allows the jaw ends to be moved toward and away from one another without permitting the pawl member to interfere with the series of teeth 24.

When manually moving the first and second elongated members 12 and 16 toward one another to cause their respective jaws to engage a workpiece 62, the control arm 40 moves downwardly to compress the coil spring 48 which applies a forward pressure to bolt 28 and is effective in moving the pawl into contact with the channel sidewall along the series of teeth 24. As this occurs the camming surface 36 slides over two of the teeth 24 causing the pawl member to pivot so that its tip 38 enters between two adjacent teeth 24 creating a positive gripping and holding force on the workpiece 62.

The spring 48 carried in the handle end 16*b* normally acts against the adjacent end of the control arm 48, causing the control arm 40 to pivot on guideball 54, to the right as viewed in FIG. 1, whereby force against the pin 42 causes the arm 12 to retract and open the jaws 12*a* and 16*a* to their fullest extent. The aforedescribed pivoting action of the control arm 40 is accompanied by a counter pivoting action of the member 12 whereby the pawl 26 slides down the full length of the channel 20 as viewed in FIG. 1 but with the cam in the disposition shown in FIG. 2 whereby it does not engage any of the teeth 24.

Manipulation of the pliers 10 to grip a workpiece is accomplished by the user grasping the handle ends 12*b* and 16*b* by closing the hand thereabout and squeezing the handle ends toward each other. This action results in the member 12 pivoting clockwise on the pivot pin 42 whereby the jaw end 12*a* moves toward jaw end 16*a*, and the pawl 26 advances in a sliding action up the channel or slot 20, as viewed in FIG. 1, until the jaws stop in contact with the workpiece. Contact of the jaws with the workpiece causes a pivoting motion between the neck portions 12*c* and 16*c* of the members 12 and 16, which action is translated to the pawl 26, causing it to move from the raceway of the channel 20 and against the opposted wall having the series of teeth 24. The tips of the teeth 24 and that portion of the opposing wall which has no teeth present a coacting surface against which the camming surface 36 will contact and cause the cam to pivot clockwise whereby its tip 38 will engage in a notch between two of the teeth and perform a locking action against further sliding action between the neck portions 12*c* and 16*c*. Continued manual pressure against the handle end 12*b* and 16*b* will then cause the jaw ends 12*a* and 16*a* to tightly grip the workpiece.

In the case of a particularly small or narrow workpiece, the camming surface 36 of the pawl 26 will cam against the area of the opposing wall in the upper end of the channel 20 to cause the pawl to pivot and lock its tip 38 into the nearest notch between adjacent teeth 24.

From the foregoing description of the pliers 10 it should be appreciated that the pawl 26, the bolt 28 and the interaction of the pawl with the specially configured slot 20 constitutes a fastening means connecting the members 12 and 16 between the neck portions 12*c* and 16*c* whereby the jaw ends 12*a* and 16*a* will close toward each other and grip a workpiece between them in response to manual closing force being applied on the handle ends 12*b* and 16*b*. This fastening means includes sliding and pivotal structure adapted to first slide the neck portion 12*c* relative the neck portion 16*c* to move the jaw ends 12*a* and 16*a* toward each other in a workpiece gripping action. The fastening means next acts to lock the neck portions against further sliding action and simultaneously triggers a pivotal action, in response to the jaws' contacting the workpiece therebetween. Then, increased exertion manually on the handle ends operates through the pivotal structure of the fastening means as a gripping force directed against the workpiece by the jaw ends.

Release of the manual gripping pressure on the handle ends permits the spring 48 to take over and pivot the control arm 40 on ball 54 which action translates as an automatic opening action whereby the jaw ends move to a fully open disposition readily disposed for the next use in automatically adjusting and gripping a nut, pipe, or other object of any size equal to or smaller than the maximum distance between the fully open jaws.

Although the present invention has been described in connection with a preferred embodiment and one modification thereof, it is to be understood that other embodiments or variations may be made without departing from the spirit and scope of the invention, as those skilled in the art will readily understand. Such embodiments and variations are considered to be within the purview and scope of the invention and the appended claims.

For the purpose of explaining the structure and operation of the invention, the "normal" position of the disclosed pliers and all parts thereof, is when the jaws and handle ends are at their fullest open range or position.

The ball 54, as shown in FIG. 1, serves as a pivot point for the control arm 40, and is adapted to slideably shift generally longitudinally on the handle member 10 when a workpiece is engaged between the jaw ends 12*a* and 16*a* and manual force is exerted to close the handle ends 12*b* and 16*b*. The compressible biasing means or spring member 48 normally urges the end of the control arm 40 to the position shown in FIG. 1, and the ball 54 is shiftable along the channel 52 in which it is carried, during use or operation of the tool.

In the pliers 10, when manual force is exerted to move the handles 12*b* and 16*b* toward each other to move the jaw ends 12*a* and 16*a* to grip a workpiece, the normally open jaw 12*a* begins to slide relative toward the jaw 16*a*, and the pawl 26 moves moves upwardly in the slot 20, as viewed in FIG. 1. Simultaneously, the handle member 12, as viewed in FIG. 1, pivots slightly clockwise on the pin 42. Continued exertion of the manual force whereby the jaw ends 12*a* and 16*a* press against the workpiece causes a tranformation in the direction of forces through the handle members 12*a* and 16*a*, and a generally linear force is exerted on the control arm 40 whereby its end, at ball 54, forces spring 44 to slightly compress, moving the ball 54 generally longitudinal on the handle member 10 a short distance through the channel 52. The resistance or counterforce of the spring 44 against the end of the control arm 40 is translated as a pushing action through the control arm 40 against the pin 42 whereby the handle 12 is caused to shift slightly in the direction of the workpiece. This action causes the pawl 26 to pivot whereby its tip 38 engages between teeth 24. Then, continuation of the manual force of the handle members 12*b* and 16*b* causes the handle members to pivot at bolt 28 such that the manual force is translated directly as a gripping force on the workpiece.

Figure 2:
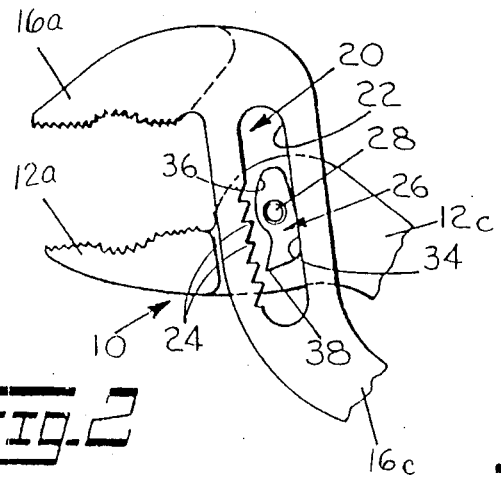
FIG. 2 is a side elevational view of a section of the pliers first shown in FIG. 1 but showing certain components in a different disposition consistent with the use and operation of the invention.
Figure 3:
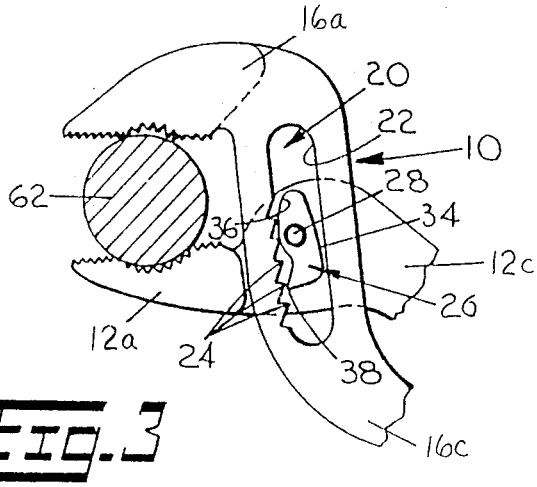
FIG. 3 is a view similar to FIG. 2 showing disposition of certain components of the pliers first shown in FIG. 1, consistent with the use of the pliers just prior to engaging a workpiece.

In accordance with the forgoing operational description, the disposition of the jaws shown in FIG. 2 is as they appear when manual force, in a closing action, has been exerted against the pliers handle member ends, but no workpiece is located between the jaws. Comparing FIG. 3 to FIG. 2, the relative disposition of the pawl 26 should be noted. FIG. 3 shows the pawl 26 just before it is cammed, clockwise as viewed, to engage on one of the teeth 24 in accordance with the size of the workpiece 62 contained between the jaw ends. An examination of FIG. 1 shows the jaw ends gripping a relatively larger workpiece 62, and the disposition of the pawl as it begins to slide upwardly in the slot 22 in response to a manual closing force being exerted against the handle member ends 12*b* and 16*b*. As the closing force is continued, the pawl 26 shown in FIG. 1 will pivot on the bolt 28. This pivotal action is caused by the camming surface 36 of the pawl 26 impinging the teeth 24. Pivoting of the pawl 26 will cause the tip 38 to engage between teeth 24, after which continued closing force will cause the handle member 12 to pivot relative to the handle member 10 and more firmly grip the workpiece.

The operational action of the various components shown in FIG. 6 are the same as that heretofore described with reference to FIG. 1. Compared to the handle members shown in FIG. 1, FIG. 6 shows provision of a single channel 46 in which the compressible spring 48 is carried, and the end of the control arm 40 is secured to pivot and slide. Further, the torsion spring 56 provides a positive assist to the control arm 40 and the handle member 12 whereby the jaw ends of the pliers are more firmlly urged toward their normally fully open position.

In accordance with the structure and operational characteristics of the pliers heretofore described, the slot 22 and bolt 28 serve as intermediate means on the handle members for slideably interconnecting the handle members whereby a manual closing action causes the jaw ends to move toward each other in a first sliding action. This intermediate means includes releasable engagement means, shown in FIG. 1, for example, in the form of the pawl 26 and the teeth 24, for halting the sliding action and converting it to a pivoting action of the handle members. This releasable engagement means is normally urged to release or disengage by the force applied through the handle member 12 by the control arm 40, which causes the planar surface 34 of the pawl 26 to slide against the sidewall or raceway 22. This sidewall serves as a track against which the pawl 26 slides during opening action of the tool to its normal or released disposition.

I claim:

1. Self-adjusting utility pliers for automatically gripping workpieces of different sizes, comprising:

first and second rigid elongated members each having a jaw end, a handle end, and an intermediate neck portion;

slideable and pivotable fastening means connecting the members between their neck portions and permitting the jaw ends to move toward each other in a sliding action in response to an initial manual force being applied to close the handle ends toward each other to grasp a workpiece between the jaw ends;

biasing means coacting between the members and normally urging the jaw ends to slide away from each other to a fully opened disposition; and the fastening means adapted to halt further sliding action of the members in response to the jaw ends contacting the workpiece and to then translate the manual force on the handle members into a pivoting gripping action of the jaw ends against the workpiece.

2. The self-adjusting utility pliers of claim 1 wherein the fastening means includes an elongated slot in the neck portion of the first of the members, the slot having a series of projections along one sidewall thereof, a fastener stationarily secured to the neck portion of the second member and having a post portion projecting through the slot, and means on the post portion adapted to engage along the projections and thereby halt the sliding action between the members in response to the jaw ends contacting the workpiece.

3. The self-adjusting utility pliers of claim 2 wherein the means on the post portion is a pawl rotatably mounted thereon and adapted to cam against the slot sidewall and engage one of the projections to halt the sliding action.

4. The self-adjusting utility pliers of claim 3 wherein the pawl has a cam surface disposed to be registerable with the projections to effect rotative movement of the pawl to a position of locking engagement along the projections.

5. The self-adjusting pliers of claim 1 wherein the biasing means includes a control arm interconnecting the members intermediate the handle ends and the fastening means.

6. The self-adjusting utility pliers of claim 1 wherein the biasing means includes at least one spring which is mounted on a first of said members and operatively connected to the second of said members to normally urge the jaw ends toward their fully opened disposition.

7. The self-adjusting utility pliers of claim 6 wherein the biasing means further includes an elongated control arm interconnecting the members and having one end slideably connected to the first member and the other end pivotably connected to the second member.

8. The self-adjusting utility pliers of claim 7 further including a spring on the first member for exerting a force against the one end of the control arm to bias it toward the neck portion of the first member.

9. The self-adjusting utility pliers of claim 7 wherein the biasing means further includes a spring on the second member for exerting a pivoting force on the control arm.

10. Utility pliers for gripping workpieces of different sizes, comprising:

first and second rigid, elongated members each having a jaw end, a handle end, and an intermediate neck portion;

slideable and pivotable fastening means connecting the members between their neck portions and permitting the jaw ends to move toward each other in a sliding action in response to an initial manual force being applied to close the handle ends toward each other to grasp a workpiece between the jaw ends;

means providing a self-adjusting action to the pliers and normally urging the jaw ends toward their fully open position, including a control arm extending between the members and having a first fixed pivot point on one of the handle members and a second shiftable pivot point on the second handle member, and the second pivot point being mounted to slideably shift away from its normal position when force is applied to the members and a workpiece is grasped between their jaw ends.

11. Utility pliers capable of self-adjustment for gripping different size workpieces, comprising:

a pair of rigid, elongated handle members having opposed respective jaw ends and handle ends;

the handle members having intermediate means slidably and pivotally interconnecting them whereby a manual closing action of the handle members causes the jaw ends to move toward each other in a sliding action to grip a workpiece;

the intermediate means including releasable engagement means for engaging the members to each other and halting the sliding action while permitting the members to pivot relative to each other; and means normally urging the releasable engagement means to release.

12. The utility pliers of claim 11 wherein the releasable engagement means includes a pawl secured to a first of said handle membes for engageably coacting with a track on the second handle member.

13. The utility pliers of claim 11 further including means coacting between the handle members for normally urging them to slide such that the jaws move to their fully open position.

14. The utility pliers of claim 13 wherein the coacting means includes means for actuating the releasable engagement means to engage in response to the jaw ends pressing against a workpiece disposed between them when manual pivoting force is exerted on the handle ends to move them toward each other.

* * * * *

US004651598B1

REEXAMINATION CERTIFICATE (3317th)

United States Patent [19] [11] B1 4,651,598

Warheit [45] Certificate Issued Sep. 9, 1997

[54] SELF-ADJUSTING UTILITY PLIER

[76] Inventor: William A. Warheit, 121 Iroquois Dr., Butler, Pa. 16001

Reexamination Request:
No. 90/004,262, Jun. 4, 1996

Reexamination Certificate for:

| | |
|---|---|
| Patent No.: | **4,651,598** |
| Issued: | **Mar. 24, 1987** |
| Appl. No.: | **654,405** |
| Filed: | **Sep. 26, 1984** |

[51] Int. Cl.[6] ..... B25B 7/04

[52] U.S. Cl. ..... 81/407; 81/405; 81/408; 81/314; 81/394

[58] Field of Search ..... 81/393, 394, 405, 81/407, 409.5, 411, 413, 406, 408, 409, 412

[56] References Cited

U.S. PATENT DOCUMENTS

| | | | |
|---|---|---|---|
| 434,409 | 8/1890 | Sutton et al. | 81/427 |
| 474,987 | 5/1892 | Church | 81/413 |
| 2,531,285 | 11/1950 | Manspeaker . | |
| 4,269,089 | 5/1981 | Hastings . | |
| 4,438,669 | 3/1984 | Hastings et al. . | |
| 4,651,598 | 3/1987 | Warheit | 81/407 |
| 4,662,252 | 5/1987 | Warheit | 81/385 |
| 5,351,584 | 10/1994 | Warheit | 81/413 |

FOREIGN PATENT DOCUMENTS

| | | |
|---|---|---|
| 0218760 | 4/1987 | European Pat. Off. . |
| 2031661 | 9/1972 | Germany . |

*Primary Examiner*—James G. Smith

[57] ABSTRACT

Utility pliers for single-handed manual manipulation which will automatically adjust to positions of positive gripping and holding of any size workpiece within the size range defined by the maximum opening between the jaws of the pliers.

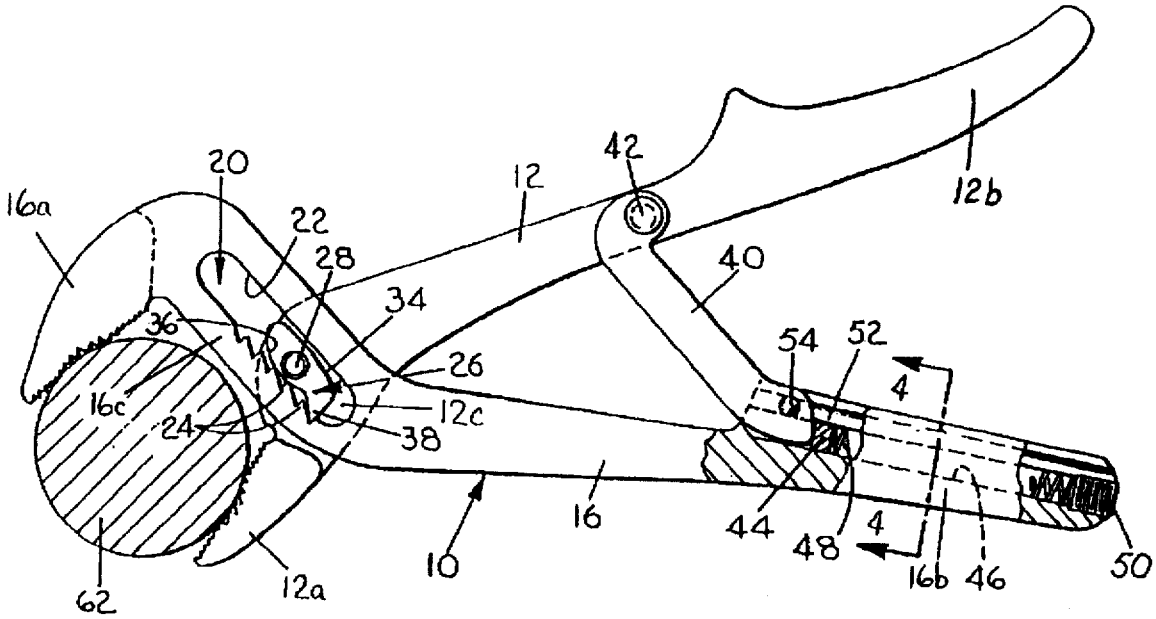

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–10 is confirmed.

Claim 13 is cancelled.

Claims 11 and 14 are determined to be patentable as amended.

Claim 12, dependent on an amended claim, is determined to be patentable.

New claims 15–20 are added and determined to be patentable.

11. Utility pliers capable of self-adjustment for gripping different size workpieces, comprising:

a pair of rigid, elongated handle members having opposed respective jaw ends and handle ends;

the handle members having intermediate means [slidably] *slideably* and pivotally interconnecting them whereby a manual closing action of the handle members causes the jaw ends to move toward each other in a sliding action to grip a workpiece;

the intermediate means including releasable engagement means for engaging the members to each other and halting the sliding action while permitting the members to pivot relative to each other; [and]

means normally urging the releasable engagement means to release; *and*

*an arm pivotally interconnected to the handle members between the handle ends and the intermediate means and biased to urge the jaw ends to slide away from each other.*

14. The utility pliers of claim [13] *11* wherein the [coacting means] *arm* includes means for actuating the releasable engagement means to engage in response to the jaw ends pressing against a workpiece disposed between them when manual pivoting force is exerted on the handle ends to move them toward each other.

15. *The utility pliers of claim 11 wherein the arm is operatively connected to at least one handle member through a first spring that assists the jaw ends in sliding away from each other to their open disposition.*

16. *The utility pliers of claim 11 wherein the arm comprises at least one elongated bar.*

17. *The utility pliers of claim 15 wherein the arm comprises at least one elongated bar.*

18. *The utility pliers of claim 15 wherein the arm has a first end and a second end and the first end is pivotally and slideably connected to a first of the handle members and the second end is pivotally connected to the second of the handle members.*

19. *The utility pliers of claim 18 wherein the first spring is mounted on the first handle member and connected to the first end of the arm so as to exert a force pushing the first end of the arm toward the jaw end of the first handle member.*

20. *The utility pliers of claim 19 wherein a second spring is mounted on the second handle member to exert a pivoting force on the arm.*

* * * * *